US005371318A

United States Patent [19]

Hsu et al.

[11] Patent Number: 5,371,318

[45] Date of Patent: Dec. 6, 1994

[54] MOTION GENERATION MECHANISM FOR A MUSIC BOX

[76] Inventors: Feng H. Hsu, 7th Fl., No. 9, Lane 100, Ho Chiang Street; Ching-fa Huang, 5th Fl., No. 7-1, Alley 56, Lane 166, Shin Pai Rd. Set. 1, both of Taipei, Taiwan, Prov. of China

[21] Appl. No.: 130,450

[22] Filed: Oct. 1, 1993

[51] Int. Cl.[5] ..... G10F 1/06; G10F 19/08

[52] U.S. Cl. ..... 84/95.2; 40/418; 446/265; 446/303; D17/24

[58] Field of Search ..... 84/95.1, 95.2, 94.1, 84/94.2; 40/418, 419, 420; 446/265, 303; D17/24

[56] References Cited

U.S. PATENT DOCUMENTS 1,593,286 7/1926 Brown ..... 40/418

2,840,949 7/1958 Faulkner ..... 84/95.2

*Primary Examiner*—M. L. Gellner

*Assistant Examiner*—Cassandra C. Spyrou

*Attorney, Agent, or Firm*—Browdy and Neimark

[57] ABSTRACT

A motion generation mechanism particularly adapted for use in a music box is mounted in connection to the driving spring of a music box so as to permit the motion generation mechanism to actuate the head and limbs of a doll-like object to motion in tune with the music played by the music box. The motion generation mechanism is equipped with a first swing wire and follower arm wherein the follower arm is actuated by the swing wire to produce a swinging motion and a driving shaft associated with the follower arm is accordingly twisted back and forth. In the meanwhile, the second, third and fourth sets of swing wires and follower arms are driven by the back and forth twisted driving shaft to produce repetitive swing motions, causing the head, limbs of a doll-like object to move or dance in tune with the music.

1 Claim, 4 Drawing Sheets

MOTION GENERATION MECHANISM FOR A MUSIC BOX

BACKGROUND OF THE INVENTION

The present invention relates to a motion generation mechanism in operational connection to a conventional music box so as to permit a doll-like object to move its head, limbs in tune with the music played by the music box.

Generally speaking, Conventional music box can only play music without any additional movable objects associated therewith. Those music boxes soon become boring to play after a short period of time to most children.

SUMMARY OF THE INVENTION

Therefore, the primary object of the present invention is to provide a motion generation mechanism for use in a music box which is operationally connected to and powered by the spring means of the music box so that a doll or a like object can be mounted onto the music box and the limbs and head of the same can be moved in tune with the music played by the music box.

Another object of the present invention is to provide a motion generation mechanism which is comprised of a pair of driving shafts, a number of swing wires and a number of follower arms which can actuate the swing wires in tune with played music, resulting in the motion of the limbs and head of a doll-like object.

DETAILED DESCRIPTION OF THE PREFERRED EMBODIMENTS

Figure 1:
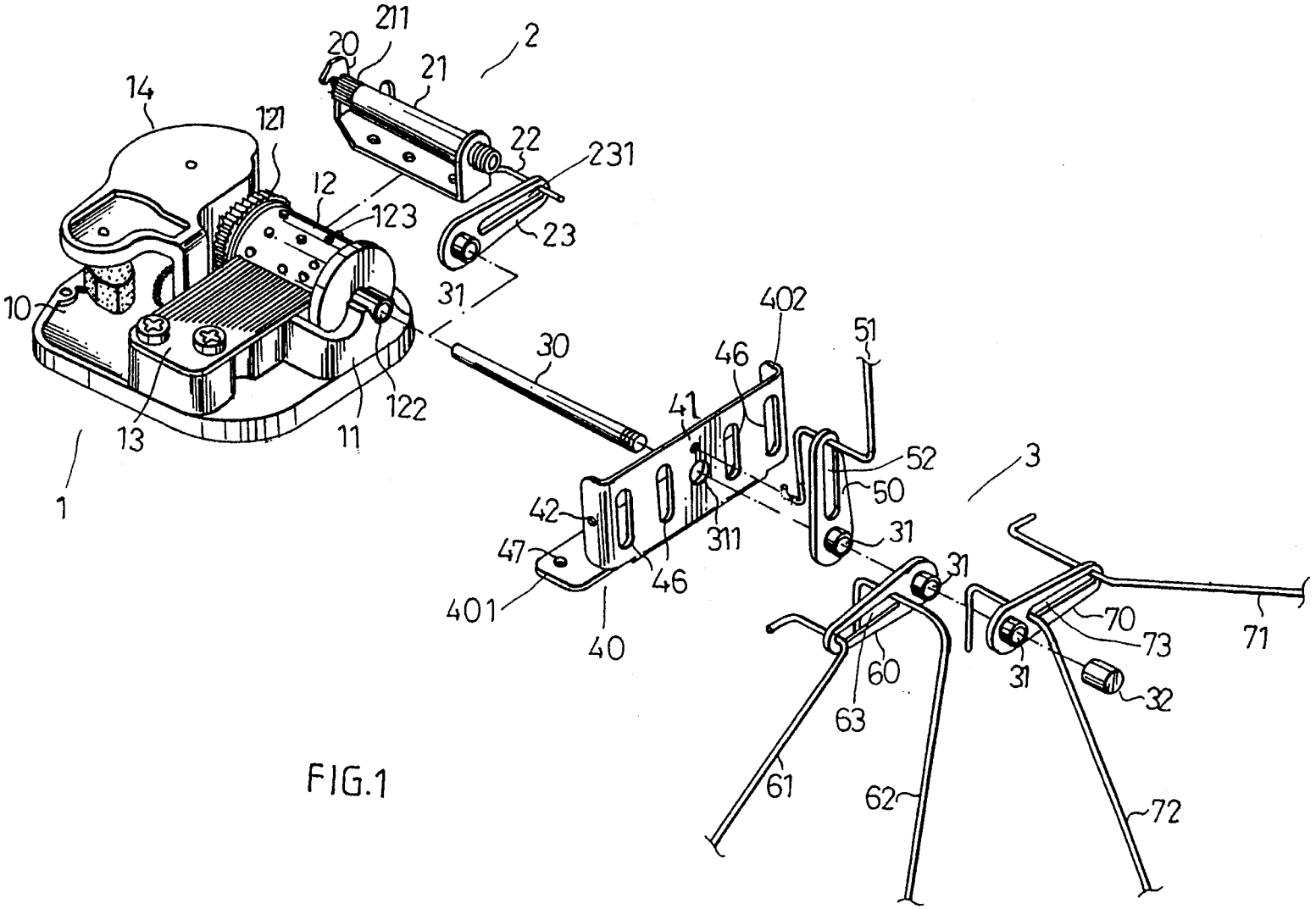
FIG. 1 is a perspective of the exploded components of the present invention.
Figure 2:
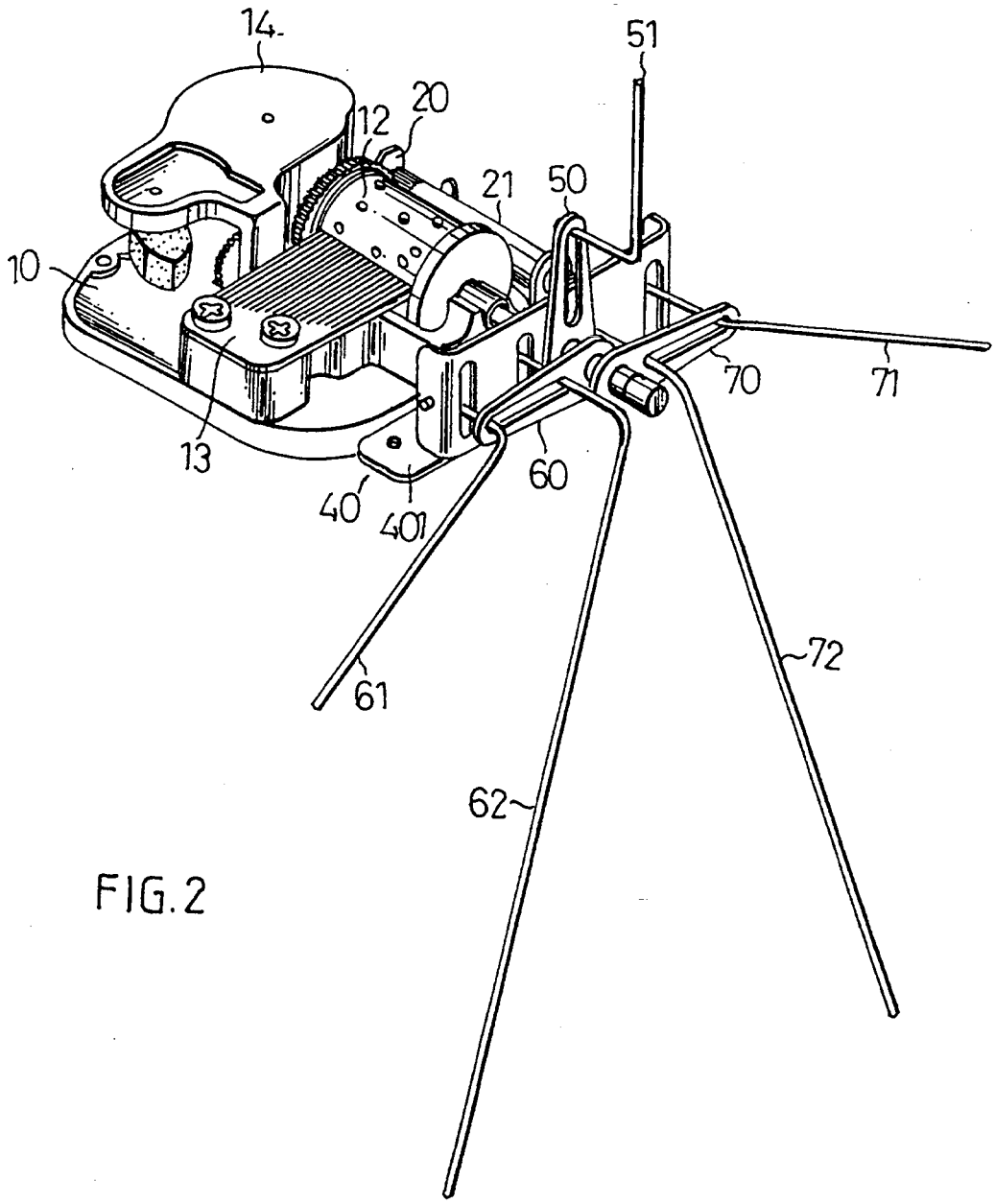
FIG. 2 is a diagram showing the present invention in an assembled manner.

Referring to FIG. 1, the present motion generation mechanism for use in a music box is comprised of a music playing unit 1, a transmission unit 2, a swinging unit 3.

The music playing unit 1 includes a mounting base 10, a housing cavity 11, a spring driving means 14, a comb-like music playing member 13, a roller 12 having a plurality of predefined projection spots 123, a gear member 121, and a shaft supporting sleeve 122. In operation, the spring driving means 14 is tightened up first so as to make the roller 12 spin in clockwise direction and the projection spots 123 thereon will actuate the respective teeth of the comb-like music playing member 13 to vibrate, producing music continuously as long as the roller is driven by the spring.

Included in the transmission unit 2 are a driving shaft mount 20, a driving shaft 21, a swing wire 22, a first follower arm 23 and a tapered driving shaft 30. The driving shaft mount 20 is secured in place on the mounting base 10 next to the right of the roller 12. Onto the driving shaft mount 20 is mounted the driving shaft 21 which is provided with a gear 211 at one end thereof engaging with the gear member 121 of the roller 12, permitting the driving shaft 21 to spin in the counter-clockwise direction on the mount 20.

The other end of the driving shaft 21 extends out of the driving shaft mount 20 and is provided with a shaped swing wire 22 which is movably engaged with a slot 231 of the first follower arm 23. The length of the slot 231 is equal to the diameter of the moving orbit of the swing wire 22.

The tapered driving shaft 30 is led through and in locking engagement with a locking sleeve 31 disposed at one end of the first follower arm 23 and is in rotational engagement with the supporting sleeve 122 so as to permit the driving shaft 30 to be twisted back and forth along with the swinging of the first follower arm 23 caused by the rotation of the driving shaft 21 which actuates the shaped swing wire 22 and the first follower arm 23 and finally the driving shaft 30 to operate.

Figure 3:
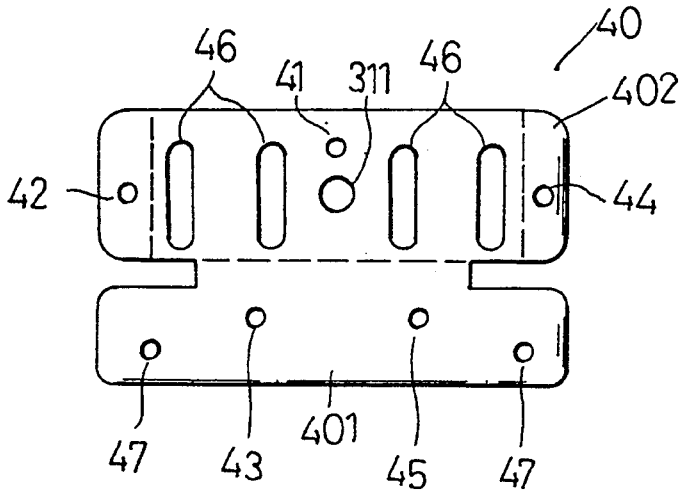
FIG. 3 is a diagram showing the layout of the fixing frame before being bent.
Figure 4:
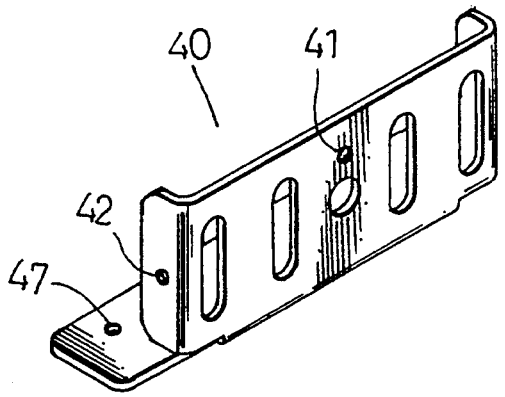
FIG. 4 is a perspective of the fixing frame.

The swinging unit 3 is comprised of a fixing frame 40, the second, third, and fourth follower arms 50, 60, 70, and the second swing wire 51, and the third swing wires 61, 62, and the fourth swing wires 71, 72. The fixing frame 40 is provided with a through hole 311 at the center of the vertical portion 402 thereof with a hook engagement hole 41 disposed thereabove. There are two vertical slots 46 defined on each side of the through hole 311. Both edges of the vertical portion are bent backwardly in a right angle, as shown in FIGS. 3, 4, and one of the hook engagement holes 42, 44 is defined on the respective bent edge. Adjacent each end of the horizontal portion 401 of the fixing frame 40 is disposed a through hole 47 and two symmetric holes 43, 45 are disposed therebetween, as shown in FIG. 3.

The tapered driving shaft 30 is led through the through hole 311 of the fixing frame 40 and engaged with the second, third, and fourth follower arms 50, 60, 70 at the end thereof. The second follower arm 50 is disposed in a vertical manner and the third and fourth follower arms 60, 70 are placed horizontally with one directed to the right and the other to the left.

The swing wire 51 is led through the slot 52 and is engaged with the hook engagement hole 41 at one end. Swing wires 61, 62 are led through the slots 63 of the follower arm 60 and abut against each end of the slot 63, and the ends of the swing wires 61, 62 are led through the vertical slots 46 and are securedly engaged with the holes 42, 43. In the same manner, the swing wires 71, 72 are led through the slot 73 of the fourth follower arm 70 and further through the vertical slots 46 respectively and engaged with the engagement holes 44, 45 and abut against the edges of the slot 73. A nut cap 32 is removably secured to the end of the tapered driving shaft 30 for locking the follower arms in place.

Figure 5:
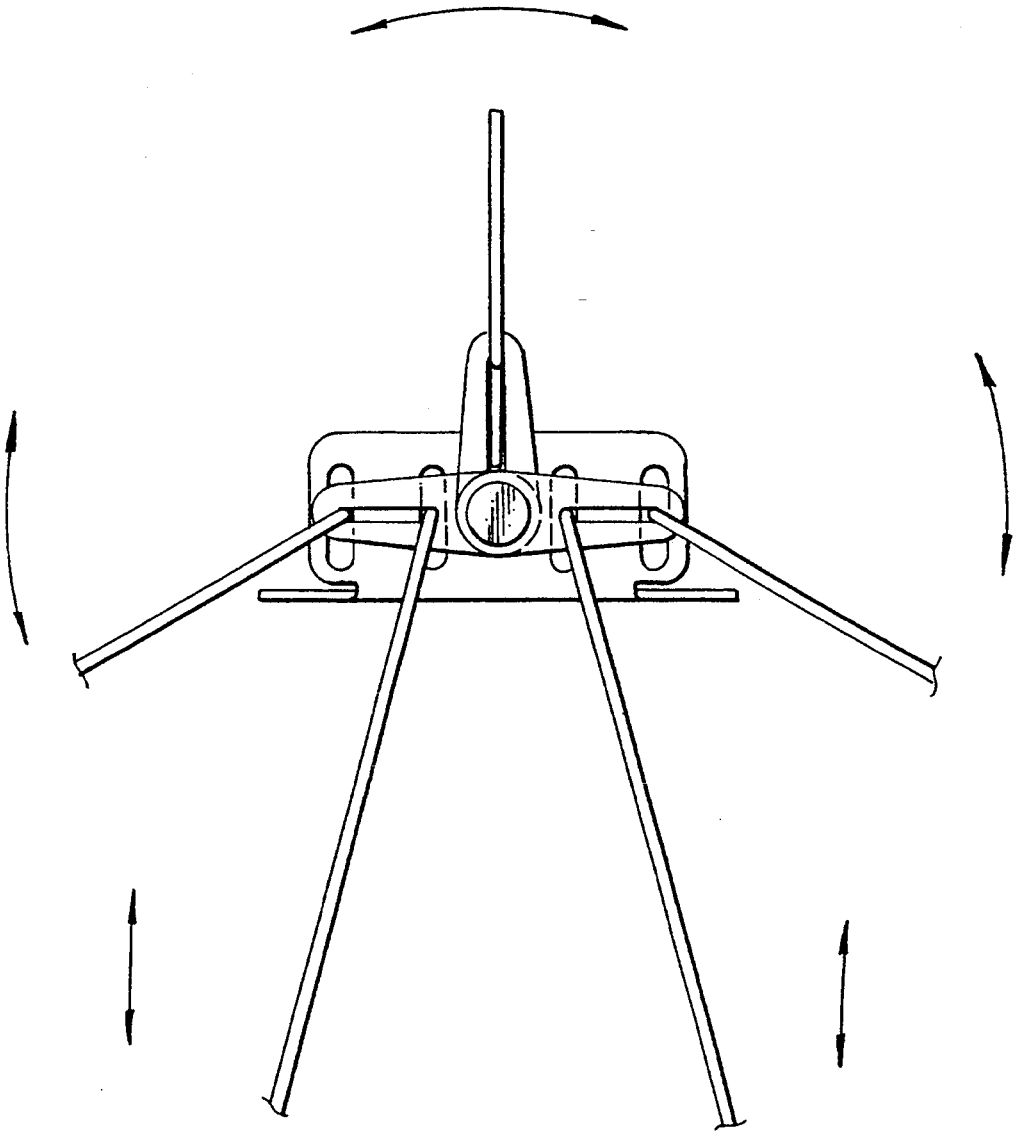
FIG. 5 is a diagram showing the motion of the swing wires of the present invention.

As the spring driving means 14 actuates the roller 12 to spin with the projection spots 123 thereon abutting against the ends of the respective teeth of the music playing means 13 so as to produce music accordingly. In the meanwhile, the rotation of the roller 12 actuates the swing wire 22 disposed at the end of the driving shaft 21 to make the first follower arm 23 swing back and forth in a certain range. At the same time, the tapered driving shaft 30 is twisted to spin back and forth by the first follower arm 23, resulting in the swinging of the second, third and fourth follower arms 50, 60, 70. Accordingly, the swing wire 51 is actuated to pivot about the hole 41 from left to right and the swing wires 61, 71 are forced to swing back and forth about the hook engagement holes 42, 44; and the swing wires 62, 72 are made to move vertically up and down, as shown in FIG. 5.

It can be clearly seen that the present motion generation mechanism is mounted in connection to a conventional music playing device and can drive a number of follower arms along with swing wires which are associated with the limbs and head of a doll whereby the doll can dance with the played music accordingly.

We claim:

1. A motion generation mechanism particularly adapted for use in a music box comprising:

a music playing unit;

a transmission unit;

a swing unit;

said music playing unit further comprising:

a mount base having a housing cavity;

a spring driving means disposed on said mount base;

a roller rotatably disposed in said housing cavity on which a plurality of predefined protrusion spots being arranged in a particular order;

a comb-like music playing member having a plurality of vibratable teeth of different length;

said roller driven by said spring driving means being disposed adjacent to said comb-like music playing member such that the ends of said teeth come into selective contact with said projection spots as said roller is rotated by said spring driving means;

said roller being provided with a gear means at one end thereof and a supporting sleeve at the other end thereof;

said transmission unit further comprising:

a shaft mount;

a driving shaft rotatably mounted onto said shaft mount;

a gear secured at one end of said driving shaft;

a first swing wire secured at the other end of said driving shaft;

a first follower arm having a slot in which said first swing wire is disposed to freely move; a locking sleeve being disposed at one end thereof;

a tapered driving shaft having one end disposed in said supporting sleeve of said roller and being in tight engagement with said locking sleeve of said first follower arm so as to permit said tapered driving shaft to be twisted along with the swinging of said first follower arm;

said swinging unit further comprising:

a fixing frame having a horizontal portion and a vertical portion;

said vertical portion being provided with a central through hole and with a hook engagement hole disposed right thereabove; and a pair of slots on each side of said central through hole;

and right and left edges being bent in a right angle with a hole disposed at respective centers thereof;

a second follower arm having a slot and a locking sleeve at one end thereof;

said horizontal portion of said fixing frame being provided with a plurality of holes for fixing of swing wires;

a third follower arm and a fourth arm each of which is provided with a locking sleeve and a slot;

said second, third, and fourth follower arms being securedly attached to said tapered driving shaft;

a second swing wire having one end pivotally associated with said hook engagement hole being led through said slot of said second follower arm;

a pair of third swing wires led through said slot of said third follower arm and through respectively one of said pairs of vertical slots on said vertical portion of said fixing frame and one of said third swing wires being connected to said hole on said bent left edge and the other being connected to one of said holes on said horizontal portion of said fixing frame;

a pair of fourth swing wires led through said slot of said fourth follower arm and through respectively another of said pairs of vertical slots on said vertical portion of said fixing frame and one of said third swing wires being connected to said hole on said bent right edge and the other being connected to another of said holes on said horizontal portion of said fixing frame;

a nut cap being removably secured to the end of said tapered driving shaft so as to fix said second, third, and fourth follower arms in place;

whereby said tapered driving shaft can be twisted back and forth by said first follower arm driven by said first swing wire, causing said second, third, and fourth follower arms in locking engagement with said tapered driving shaft to swing back and forth so as to make said second swing wire and said third and fourth swing wires to move accordingly in accordance to the playing of said music playing means.

* * * * *